US009624457B2

(12) United States Patent
Labeque et al.

(10) Patent No.: US 9,624,457 B2
(45) Date of Patent: Apr. 18, 2017

(54) METHOD FOR CONTROLLING THE PLASTICIZATION OF A WATER SOLUBLE FILM

(75) Inventors: Régine Labeque, Neder over Heembeek (BE); Matthijs Pietrala, Beveren (BE); Roxane Rosmaninho, Auderghem (BE)

(73) Assignee: The Procter & Gamble Company, Cincinnati, OH (US)

( * ) Notice: Subject to any disclaimer, the term of this patent is extended or adjusted under 35 U.S.C. 154(b) by 995 days.

(21) Appl. No.: 13/325,656

(22) Filed: Dec. 14, 2011

(65) Prior Publication Data

US 2012/0175797 A1 Jul. 12, 2012

(30) Foreign Application Priority Data

Jan. 12, 2011 (EP) ..... 11150711

(51) Int. Cl.

| | |
|---|---|
| ***C11D 1/22*** | (2006.01) |
| ***C11D 1/29*** | (2006.01) |
| ***C11D 1/44*** | (2006.01) |
| ***C11D 17/04*** | (2006.01) |
| ***C11D 3/43*** | (2006.01) |
| *C11D 3/20* | (2006.01) |
| *C11D 1/02* | (2006.01) |

(52) U.S. Cl.

CPC ..... *C11D 17/043* (2013.01); *C11D 3/2068* (2013.01); *C11D 3/43* (2013.01); *C11D 1/02* (2013.01); *C11D 3/2044* (2013.01); *C11D 3/2065* (2013.01); *C11D 17/042* (2013.01)

(58) Field of Classification Search

CPC ..... C11D 1/02; C11D 3/2044; C11D 3/2065; C11D 17/042

USPC ..... 510/296, 351, 439, 505, 506

See application file for complete search history.

(56) References Cited

U.S. PATENT DOCUMENTS

| | | | | |
|---|---|---|---|---|
| 4,929,380 | A | 5/1990 | Schulz et al. | |
| 5,514,302 | A * | 5/1996 | Brown | C11D 3/0031 510/279 |
| 6,166,117 | A * | 12/2000 | Miyazaki | 524/291 |
| 6,787,512 | B1 * | 9/2004 | Verrall et al. | 510/293 |
| 7,464,519 | B2 * | 12/2008 | Fisher et al. | 53/453 |
| 8,276,756 | B2 * | 10/2012 | Denome | B65D 65/46 206/524.7 |
| 8,697,624 | B2 * | 4/2014 | Denome | B65D 65/46 206/524.7 |
| 9,133,329 | B2 * | 9/2015 | Denome | B65D 65/46 |
| 2002/0045559 | A1 * | 4/2002 | Forth et al. | 510/297 |
| 2003/0199414 | A1 * | 10/2003 | Boutique | C11D 3/2086 510/293 |
| 2006/0217288 | A1 * | 9/2006 | Wahl | C11D 3/0015 510/515 |
| 2006/0276364 | A1 * | 12/2006 | Kouvroukoglou | C11D 3/201 510/293 |
| 2007/0105739 | A1 | 5/2007 | Boutique et al. | |
| 2008/0185347 | A1 * | 8/2008 | Tufano et al. | 210/749 |
| 2008/0242584 | A1 * | 10/2008 | Wahl | C11D 3/227 510/517 |
| 2009/0163399 | A1 * | 6/2009 | Corradini | C11D 17/046 510/296 |
| 2009/0325848 | A1 * | 12/2009 | Brown | C11D 17/042 510/296 |
| 2010/0240565 | A1 * | 9/2010 | Corradini | C11D 3/42 510/276 |
| 2011/0177994 | A1 * | 7/2011 | Wahl | C11D 3/227 510/516 |
| 2011/0186467 | A1 * | 8/2011 | Denome | B65D 65/46 206/524.7 |
| 2011/0186468 | A1 * | 8/2011 | Denome | B65D 65/46 206/524.7 |
| 2011/0188784 | A1 * | 8/2011 | Denome | B65D 65/46 383/1 |
| 2011/0189413 | A1 * | 8/2011 | Denome | B65D 65/46 428/35.4 |
| 2012/0108487 | A1 * | 5/2012 | Graham et al. | 510/221 |
| 2013/0256182 | A1 * | 10/2013 | Petrovicova et al. | 206/524.7 |

FOREIGN PATENT DOCUMENTS

| | | |
|---|---|---|
| EP | 01400460 | 1/2003 |
| EP | 1 666 579 A1 | 6/2006 |
| WO | WO 2004/108876 A1 | 12/2004 |
| WO | WO 2006/045391 A1 | 5/2006 |
| WO | WO 2006/088980 A1 | 8/2006 |

OTHER PUBLICATIONS

Intl Search Report 5 Pages, (Mar. 2012).

Forcinio, "Packaging Innovations", Pharmaceutical Technology , Aug. 2003, vol. 27, Issue No. 8 pp. 18 to 26. http://images.alfresco.advanstar.com/alfresco_images/pharma/2014/08/22/9320e0a1-6d93-4e2e-ae63-35426dd42be7/article-66565.pdf.

* cited by examiner

*Primary Examiner* — Gregory R Delcotto

(74) *Attorney, Agent, or Firm* — Gregory S. Darley-Emerson; Leonard W Lewis; Steven W Miller

(57) ABSTRACT

The present invention relates to a method for controlling the plasticization of a water soluble film comprising preparing a detergent composition comprising anionic surfactant and solvent system comprising at least one primary solvent having Hansen solubility (δ) of less than 30 and encapsulating said composition in a water soluble film to form a pouch unitized dose product.

17 Claims, 1 Drawing Sheet

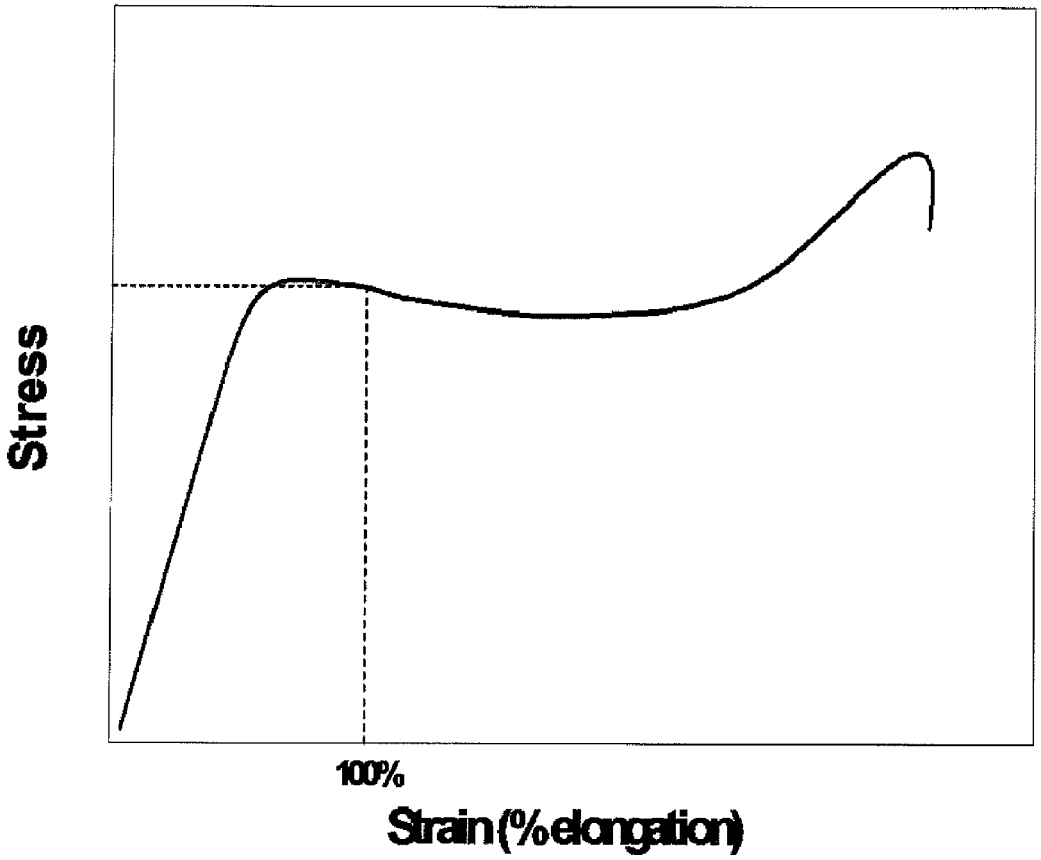
Stress
100%
Strain (% elongation)

METHOD FOR CONTROLLING THE PLASTICIZATION OF A WATER SOLUBLE FILM

TECHNICAL FIELD

The present invention relates to the control of the plasticization of a water-soluble film, when said film is used to prepare a unit dose product.

BACKGROUND

Water-soluble unitized dose products have become popular in recent years. The compositions held within the water-soluble film must have a controlled amount of water so as not to preemptively dissolve the film. Instead of water, unitized dose compositions comprise solvents to solubilise ingredients and act as a carrier. In addition to these effects, solvents in the composition within the product or within the film, plasticise the film, making it more elastic and supple. However depending on the choice of solvent or amount thereof, the Applicants have found that the solvent can also negatively affect the film structure and integrity. The Applicants have found that solvents can plasticise the film to the extent that the film becomes limp, exhibiting a reduction in elasticity. When this happens the unit dose product has a soft and floppy appearance, which consumers perceive negatively. The Applicants have therefore sought to understand the effect of solvent, in the film or composition, on the transition of the water-soluble film from elastic to plastic, so as to more accurately formulate a composition to achieve the best elasticity and least plasticity.

SUMMARY OF THE INVENTION

According to the present invention there is provided a method for controlling the plasticization of a water soluble film comprising i) preparing a detergent composition comprising
   a) anionic surfactant and
   b) solvent system comprising at least one primary solvent having Hansen Solubility (δ) of less than 30; and ii) encapsulating said composition in a water soluble film to form a pouch unitized dose product.

BRIEF DESCRIPTION OF THE DRAWINGS

FIG. 1 is a graph showing stress vs. strain (% elongation).

DETAILED DESCRIPTION OF THE INVENTION

The present application relates to a method for controlling the over or under plasticization of a water soluble film. Plasticization is a term used to describe the elasticity, flexibility and brittleness of film. A film that is completely elastic, will recover its original shape once having been stretched. A film that is plasticized tends to lose elasticity as the plasticization is increased, losing rigidity and becoming floppy. Eventually, if plasticization continues, the film can become so weak, that it fails, rips and/or develops holes. By contrast if a plasticizer is not used, is lost or too little is used then the film becomes increasingly brittle over time, which again results in failure. Plasticizing solvents can be incorporated into the film on production, indeed this is most often the case, for ease of processing. However additional plasticizing solvent can also be present in the composition which the film encapsulates.

A composition contained within a package made from water-soluble film can not contain so much water that it affects the integrity of the film itself. Hence compositions encapsulated within water soluble films generally comprise a solvent. Said solvent can also act as a plasticizer for the film. Indeed it is this relationship between the solvent used in the composition, that used in the film itself, and the relationship between these and the plasticity of the film, that the Applicant has investigated.

The above relationship and resulting consequences of over-plasticization may be particularly visible when making unitised dose pouches comprising, for example, a cleaning detergent. When the film of the pouch is over-plasticized, the pouches may appear unattractively fragile, limp or under-filled. As more solvent is added, the film can become increasingly weak leading to the composition leaking or weeping from the pouch and/or eventually the film tearing on handling or during transport. By contrast if there is insufficient plasticization, the pouch becomes increasingly brittle, leading to extensive leakage.

Detergent Composition

The detergent composition comprises an anionic surfactant and a solvent system. The solvent system comprises at least one primary solvent having Hansen Solubility (δ) of less than 28.5.

Anionic Surfactant

The composition of the present invention comprises an anionic surfactant. Preferably the composition comprises from 1% to 80% by weight of an anionic surfactant. More preferably the composition comprises from 2 to 60%, more preferably from 7 to 50% and most preferably 10 to 40% anionic surfactant by weight of the composition.

Useful anionic surfactants can themselves be of several different types. For example, water-soluble salts of the higher fatty acids, i.e., "soaps", are useful anionic surfactants in the compositions herein. This includes alkali metal soaps such as the sodium, potassium, ammonium, and alkyl ammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Additional non-soap anionic surfactants which are suitable for use herein include the water-soluble salts, preferably the alkali metal, and ammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.) Examples of this group of synthetic surfactants are a) the sodium, potassium and ammonium alkyl sulfates, especially those obtained by sulfating the higher alcohols ($C_8$-$C_{18}$ carbon atoms) such as those produced by reducing the glycerides of tallow or coconut oil; b) the sodium, potassium and ammonium alkyl polyethoxylate sulfates, particularly those in which the alkyl group contains from 10 to 22, preferably from 12 to 18 carbon atoms, and wherein the polyethoxylate chain contains from 1 to 15, preferably 1 to 6 ethoxylate moieties; and c) the sodium and potassium alkylbenzene sulfonates in which the alkyl group contains from about 9 to about 15 carbon atoms, in straight chain or branched chain configuration, e.g., those of the type described in U.S. Pat. Nos. 2,220,099 and 2,477,383. Especially preferred are linear straight chain alkylbenzene sulfonates in which the average number of carbon atoms in the alkyl group is from about 11 to 13, abbreviated as $C_{11}$-$C_{13}$ LAS, sodium, potassium and ammonium alkyl polyethoxylate sulfates having from 12 to 18 carbon atoms and mixtures thereof.

Solvent System

The composition of the present invention comprises a solvent system. The solvent system comprises at least one primary solvent having Hansen Solubility (δ) of less than 30, preferably greater than 10, more preferably greater than 15.

Hansen Solubility is a well known and calculated parameter based on a three component measuring system. Hansen Solubility is based on a dispersion force component ($\delta_d$), a hydrogen bonding component ($\delta_h$) and a polar component ($\delta_p$). The Hansen Solubility (δ) is derived from the total cohesive energy, which is the energy required to break all the cohesive bonds, is the combination of the dispersion forces (d), the molecular dipole forces (p) and the hydrogen bonding forces (h) according to the following equation:

$\delta^2=\delta_d^2+\delta_p^2+\delta_h^2$ δ is achieved by finding the square root of $\delta^2$ Dispersion forces are weak attractive forces between non-polar molecules. The magnitude of these forces depends on the polarizability of the molecule, and the dispersion Hansen Solubility ($\delta_d$) typically increases with increasing volume (and size) of the molecule, all other properties being roughly equal.

Hansen Solubility is calculated at 25° C., with ChemSW's molecular modeling Pro v6.1.9 software package which uses an unpublished proprietary algorithm that is based on values published in the Handbook of solubility Parameters and other parameters by Allan F M Barton (CRC Press 1983) for solvents obtained experimentally by Hansen.

The primary solvent preferably has molecular weight of less than 1500, more preferably less than 1000, even more preferably less than 700. The primary solvent preferably has a molecular weight of greater than 10, more preferably greater than 100. The primary solvent preferably has a c Log P of greater than −1.0 and more preferably less than +10. The primary solvent preferably has a Hydrogen bonding component ($\delta_h$) of less than 20.5, and preferably greater than 10.

The primary solvent is preferably selected from the group consisting of polyethylene glycol (PEG) polymer having molecular weight between 300 and 600, dipropylene glycol (DPG), nbutoxy propoxy propanol (nBPP) and mixtures thereof. More preferably the primary solvent is selected from the group consisting of polyethylene glycol (PEG) polymer having molecular weight between 400 and 600, dipropylene glycol (DPG), nbutoxy propoxy propanol (nBPP) and mixtures thereof. Table 1 shows the Hansen Solubility components of the preferred primary solvents and some comparative solvents falling outside of the scope of the invention.

TABLE 1

| Hansen Solubility component parameters | | | | | |
|---|---|---|---|---|---|
| Solvent | δ Dispersion | δ Polarity | δ H-bonding | δ | cLog P |
| PEG 200 | 16.54 | 11.22 | 20.91 | 28.9 | −1.47 |
| PEG 300 | 16.23 | 10.09 | 20.17 | 27.8 | −1.22 |
| PEG 400 | 15.81 | 8.21 | 19.12 | 26.1 | −0.7 |

TABLE 1-continued

| Hansen Solubility component parameters | | | | | |
|---|---|---|---|---|---|
| Solvent | δ Dispersion | δ Polarity | δ H-bonding | δ | cLog P |
| PEG 600 | 18.98 | 11.22 | 20.91 | 28.9 | −0.74 |
| DPG | 16.67 | 10.86 | 20.35 | 28.5 | −0.6 |
| Propane diol | 16.41 | 10.82 | 23.07 | 30.3 | −1.1 |
| Glycerol | 17.29 | 12.22 | 27.34 | 34.6 | −1.94 |
| Sorbitol | 19.24 | 11.5 | 23.4 | 32.4 | −2.54 |
| nBPP | 15.99 | 5.42 | 8.91 | 19.1 | +1.99 |

The primary solvent is preferably present at a level of from 1 to 25%, preferably from 2.5 to 20%, more preferably from 4 to 19% by weight of the composition.

In a preferred embodiment, the solvent system also comprises a secondary solvent. The secondary solvent is preferably selected from the group consisting of glycerol, water and mixtures thereof. When the secondary solvent comprises glycerol, glycerol is preferably present at a level of less than 5%, more preferably less than 4%, more preferably less than 3%, most preferably less than 2% by weight of the composition. Preferably the glycerol secondary solvent is present at a level of greater than 0.1%, more preferably greater than 0.5%, most preferably greater than 1% by weight of the composition. The secondary solvent may also comprise water. When water is present it is preferably present at a level of less than 20%, more preferably less than 15%, most preferably less than 10% by weight of the composition.

In a further preferred embodiment the ratio of primary solvent to secondary solvent glycerol is from 7:1 to 1:5, more preferably from 6.5:1 to 1:3, most preferably 3:1 to 1:1.

Water-Soluble Film

The film of the present invention is soluble or dispersible in water, and preferably has a water-solubility of at least 50%, preferably at least 75% or even at least 95%, as measured by the method set out here after using a glass-filter with a maximum pore size of 20 microns:

50 grams±0.1 gram of pouch material is added in a pre-weighed 400 ml beaker and 245 ml±1 ml of distilled water is added. This is stirred vigorously on a magnetic stirrer set at 600 rpm, for 30 minutes. Then, the mixture is filtered through a folded qualitative sintered-glass filter with a pore size as defined above (max. 20 micron). The water is dried off from the collected filtrate by any conventional method, and the weight of the remaining material is determined (which is the dissolved or dispersed fraction). Then, the percentage solubility or dispersability can be calculated.

Preferred film materials are preferably polymeric materials. The film material can, for example, be obtained by casting, blow-moulding, extrusion or blown extrusion of the polymeric material, as known in the art.

Preferred polymers, copolymers or derivatives thereof suitable for use as pouch material are selected from polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum. More preferred polymers are selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, and most preferably selected from polyvinyl alcohols, polyvinyl alcohol copolymers and hydroxypropyl methyl cellulose (HPMC), and combinations thereof. Preferably, the level of polymer in the pouch material, for example a PVA polymer, is at least 60%. The polymer can have any weight average molecular weight, preferably from about 1000 to 1,000,000, more preferably from about 10,000 to 300,000 yet more preferably from about 20,000 to 150,000.

Mixtures of polymers can also be used as the pouch material. This can be beneficial to control the mechanical and/or dissolution properties of the compartments or pouch, depending on the application thereof and the required needs. Suitable mixtures include for example mixtures wherein one polymer has a higher water-solubility than another polymer, and/or one polymer has a higher mechanical strength than another polymer. Also suitable are mixtures of polymers having different weight average molecular weights, for example a mixture of PVA or a copolymer thereof of a weight average molecular weight of about 10,000-40,000, preferably around 20,000, and of PVA or copolymer thereof, with a weight average molecular weight of about 100,000 to 300,000, preferably around 150,000. Also suitable herein are polymer blend compositions, for example comprising hydrolytically degradable and water-soluble polymer blends such as polylactide and polyvinyl alcohol, obtained by mixing polylactide and polyvinyl alcohol, typically comprising about 1-35% by weight polylactide and about 65% to 99% by weight polyvinyl alcohol. Preferred for use herein are polymers which are from about 60% to about 98% hydrolysed, preferably about 80% to about 90% hydrolysed, to improve the dissolution characteristics of the material.

Naturally, different film material and/or films of different thickness may be employed in making the compartments of the present invention. A benefit in selecting different films is that the resulting compartments may exhibit different solubility or release characteristics.

The method of the present invention is particularly effective when using a film with bulky monomeric units. Bulky monomeric units include monomers with a group selected from the group consisting of sulphonate, 2-acrylamidp-2-methylpropane sulfonic acid; 2 methacrylamido-2-methyl propane sulfonic acid and mixtures thereof.

Most preferred film materials are PVA films known under the MonoSol trade reference M8630, M8900, H8779 (as described in the Applicants co-pending applications ref 44528 and 11599) and those described in U.S. Pat. No. 6,166,117 and U.S. Pat. No. 6,787,512 and PVA films of corresponding solubility and deformability characteristics.

The film material herein can also comprise one or more additive ingredients. For example, it can be beneficial to add plasticisers, for example glycerol, ethylene glycol, diethyleneglycol, propylene glycol, sorbitol and mixtures thereof. Other additives include functional detergent additives to be delivered to the wash water, for example organic polymeric dispersants, etc.

The effect of the plasticization of the film can be measured by comparing stress-strain of the film exposed to the composition versus the unexposed, virgin film. The stress-strain of a film can be represented on a graph, see FIG. 1. The graph of stress as a function of strain is constructed with virgin, untreated, unexposed film specimen and with the same film that has been exposed to the composition. The data is obtained using a mechanical test where load is applied to the film, and continuous measurements of stress and strain are made simultaneously. The result is a graph showing stress vs. strain (% elongation) as illustrated in FIG. 1.

The stress-strain measurements are made using an Instron 5567 Series material testing system (Instron, 100 Royall Street, Canton Mass., www.instrom.com). The instrument features Instron's Merlin application software.

All film specimens are stored at 21±1° C. and 45±5% RH for at least 24 hours prior to use. All tests are conducted in a standard laboratory conditions of 21±1° C. and 45±5% RH.

For each data point, five specimens are tested in the machine direction. The specimen, a strip of 12 cm long (in the machine direction) and 2.54 cm wide is obtained by cutting a film with JDC Precision Cutter Model JDC 1-10 (JDC Precision Cutter, Thwing Albert Instrument Company, 10960 Dutton Road, Philadelphia Pa. USA).

The thickness of the film specimen can be measured with any techniques known by the man skilled in the art. The thickness test performed as described herein is done with an electronic thickness tester, Thwing-Albert model 89-100. In any case, the compared treated and untreated specimens are identical before treatment and are thus of the same material, size, shape and thickness.

The Instron machine is set-up according to the Instron manufacturer guidelines. A load cell of 500 Newtons is attached and calibrated. The specimen sample is positioned and held between grips, pneumatically operated. The gauge length (between the grips) is set to 50 mm. The thickness of the virgin film is recorded and input into the program.

Sample Exposure to Composition

A piece of film (12×17 $cm^2$ size) is immersed in a vessel containing 300 g of the detergent. The vessel containing the film is stored in an oven for 5 days at 35° C./45% RH. After 5 days the vessel is removed from the oven and kept at 21±1° C. and 45±5% RH for 24 hours. The film is then removed and cleaned with a paper towel. Five specimens are obtained according to the procedure described above. The stress strain profile of the treated film is then measured and compared to that of the virgin, untreated film.

The graph of Stress ($\gamma$) vs. strain ($\epsilon$) is obtained and the reading is taken at 100% strain ($\epsilon_{100\%}$). This is measured for the virgin and the immersed film. The percentage change in stress that can be applied at 100% strain is calculated using the formula;

$$\gamma\%\ \text{change}=[(\gamma)_{100\%\ virgin}-(\gamma)_{100\%\ immersed}]/((\gamma)_{100\%\ virgin})]\times 100$$

In a preferred embodiment, the water soluble film when exposed to the composition of the present invention, exhibits a change in stress/strain profile versus the virgin film of less than 33%, more preferably less than 20%, even more preferably less than 15%, measured at 100% strain.

Unitised Dose Pouch

The method of the present invention includes making an encapsulated product comprising a detergent composition. The product can be a single or multi-compartment pouch.

Where the pouch is a multi-compartment pouch, the compartments preferably have a different aesthetic appearance. A difference in aesthetics can be achieved in any suitable way. One compartment of the pouch may be made using translucent, transparent, semi-transparent, opaque or semi-opaque film, and the second compartment of the pouch may be made using a different film selected from translucent, transparent, semi-transparent, opaque or semi-opaque film such that the appearance of the compartments is different. The compartments of the pouch may be the same size or volume. Alternatively the compartments of the pouch may have different sizes, with different internal volumes. The compartments may also be different from one another in terms of texture or colour. Hence one compartment may be glossy whilst the other is matt. This can be readily achieved as one side of a water-soluble film is often glossy, whilst the other has a matt finish. Alternatively the film used to make a compartment may be treated in a way so as to emboss, engrave or print the film. Embossing may be achieved by adhering material to the film using any suitable means described in the art. Engraving may be achieved by applying pressure into the film using a suitable technique available in the art. Printing may be achieved using any suitable printer and process available in the art. Alternatively, the film itself may be coloured, allowing the manufacturer to select different coloured films for each compartment. Alternatively the films may be transparent or translucent and the composition contained within may be coloured. Thus in a preferred embodiment of the present invention a first compartment has a colour selected from the group consisting of white, green, blue, orange, red, yellow, pink or purple and a second compartment has a different colour selected from the group consisting of white, yellow, orange, blue or green.

The compartments of a multi-compartment pouch can be separate, but are preferably conjoined in any suitable manner. Most preferably the second and optionally third or subsequent compartments are superimposed on the first compartment. In one embodiment, the third compartment may be superimposed on the second compartment, which is in turn superimposed on the first compartment in a sandwich configuration. Alternatively the second and third, and optionally subsequent, compartments may all be superimposed on the first compartment. However it is also equally envisaged that the first, second and optionally third and subsequent compartments may be attached to one another in a side by side relationship. In a preferred embodiment the present pouch comprises three compartments consisting of a large and two smaller compartments. The second and third smaller compartments are superposed on the first larger compartment. The size and geometry of the compartments are chosen such that this arrangement is achievable. The compartments may be packed in a string, each compartment being individually separable by a perforation line. Hence each compartment may be individually torn-off from the remainder of the string by the end-user, for example, so as to pre-treat or post treat a fabric with a composition from a compartment.

The geometry of the compartments may be the same or different. In a preferred embodiment the second and optionally third or subsequent compartment has a different geometry and shape to the first compartment. In this embodiment the second and optionally third compartments are arranged in a design on the first compartment. Said design may be decorative, educative, illustrative for example to illustrate a concept or instruction, or used to indicate origin of the product. In a preferred embodiment the first compartment is the largest compartment having two large faces sealed around the perimeter. The second compartment is smaller covering less than 75%, more preferably less than 50% of the surface area of one face of the first compartment. In the embodiment wherein there is a third compartment, the above structure is the same but the second and third compartments cover less than 60%, more preferably less than 50%, even more preferably less than 45% of the surface area of one face of the first compartment.

Process for Making the Pouch Unitized Dose Product

The pouch of the present invention may be made using any suitable equipment and method. Single compartment pouches are made using vertical, but preferably horizontal form filling techniques commonly known in the art. The film is preferably dampened, more preferably heated to increase the malleability thereof. Even more preferably, the method also involves the use of a vacuum to draw the film into a suitable mould. The vacuum drawing the film into the mould can be applied for 0.2 to 5 seconds, preferably 0.3 to 3 or even more preferably 0.5 to 1.5 seconds, once the film is on the horizontal portion of the surface. This vacuum may preferably be such that it provides an under-pressure of between +10 mbar to +1000 mbar, more preferably from +100 mbar to +600 mbar.

The moulds, in which the pouches are made, can have any shape, length, width and depth, depending on the required dimensions of the pouches. The moulds can also vary in size and shape from one to another, if desirable. For example, it may be preferred that the volume of the final pouches is between 5 and 300 ml, or even 10 and 150 ml or even 20 and 100 ml and that the mould sizes are adjusted accordingly.

Heat can be applied to the film, in the process commonly known as thermoforming, by any means. For example the film may be heated directly by passing it under a heating element or through hot air, prior to feeding it onto the surface or once on the surface. Alternatively it may be heated indirectly, for example by heating the surface or applying a hot item onto the film. Most preferably the film is heated using an infra red light. The film is preferably heated to a temperature of 50 to 120° C., or even 60 to 90° C. Alternatively, the film can be wetted by any mean, for example directly by spraying a wetting agent (including water, solutions of the film material or plasticizers for the film material) onto the film, prior to feeding it onto the surface or once on the surface, or indirectly by wetting the surface or by applying a wet item onto the film.

Once a film has been heated/wetted, it is drawn into an appropriate mould, preferably using a vacuum. The filling of the moulded film can be done by any known method for filling (preferably moving) items. The most preferred method will depend on the product form and speed of filling required. Preferably the moulded film is filled by in-line filling techniques. The filled, open pouches are then closed, using a second film, by any suitable method. Preferably, this is also done while in horizontal position and in continuous, constant motion. Preferably the closing is done by continuously feeding a second film, preferably water-soluble film, over and onto the open pouches and then preferably sealing the first and second film together, typically in the area between the moulds and thus between the pouches.

Preferred methods of sealing include heat sealing, solvent welding, and solvent or wet sealing. It is preferred that only the area which is to form the seal, is treated with heat or solvent. The heat or solvent can be applied by any method, preferably on the closing material, preferably only on the areas which are to form the seal. If solvent or wet sealing or welding is used, it may be preferred that heat is also applied. Preferred wet or solvent sealing/welding methods include applying selectively solvent onto the area between the moulds, or on the closing material, by for example, spraying or printing this onto these areas, and then applying pressure onto these areas, to form the seal. Sealing rolls and belts as described above (optionally also providing heat) can be used, for example.

The formed pouches can then be cut by a cutting device. Cutting can be done using any known method. It may be preferred that the cutting is also done in continuous manner, and preferably with constant speed and preferably while in horizontal position. The cutting device can, for example, be a sharp item or a hot item, whereby in the latter case, the hot item 'burns' through the film/sealing area.

The different compartments of a multi-compartment pouch may be made together in a side-by-side style and consecutive pouches are not cut. Alternatively, the compartments can be made separately. According to this process and preferred arrangement, the pouches are made according to the process comprising the steps of:

a) forming an first compartment (as described above);
b) forming a recess within some or all of the closed compartment formed in step (a), to generate a second moulded compartment superposed above the first compartment;
c) filling and closing the second compartments by means of a third film;
d) sealing said first, second and third films; and
e) cutting the films to produce a multi-compartment pouch.

Said recess formed in step b is preferably achieved by applying a vacuum to the compartment prepared in step a).

Alternatively the second, and optionally third, compartment(s) can be made in a separate step and then combined with the first compartment as described in our co-pending application EP 08101442.5 which is incorporated herein by reference. A particularly preferred process comprises the steps of:

a) forming a first compartment, optionally using heat and/or vacuum, using a first film on a first forming machine;
b) filling said first compartment with a first composition;
c) on a second forming machine, deforming a second film, optionally using heat and vacuum, to make a second and optionally third moulded compartment;
d) filling the second and optionally third compartments;
e) sealing the second and optionally third compartment using a third film;
f) placing the sealed second and optionally third compartments onto the first compartment;
g) sealing the first, second and optionally third compartments; and
h) cutting the films to produce a multi-compartment pouch The first and second forming machines are selected based on their suitability to perform the above process. The first forming machine is preferably a horizontal forming machine. The second forming machine is preferably a rotary drum forming machine, preferably located above the first forming machine.

It will be understood moreover that by the use of appropriate feed stations, it is possible to manufacture multi-compartment pouches incorporating a number of different or distinctive compositions and/or different or distinctive liquid, gel or paste compositions.

Optional Detergent Composition Components

The composition of the present invention is preferably a liquid. By the term 'liquid' it is meant to include liquid, paste, waxy or gel compositions. The liquid composition may comprise a solid. Solids may include powder or agglomerates, such as micro-capsules, beads, noodles or one or more pearlised balls or mixtures thereof. Such a solid element may provide a technical benefit, through the wash or as a pre-treat, delayed or sequential release component. Alternatively it may provide an aesthetic effect. The compositions of the present invention may comprise one or more of the ingredients discussed below.

Surfactants or Detersive Surfactants

The composition of the present invention preferably comprises further surfactants. The total surfactant level may be in the range of from about 1% to 80% by weight of the composition. Further detersive surfactants utilized can be of the nonionic, zwitterionic, ampholytic or cationic type or can comprise compatible mixtures of these types. More preferably surfactants are selected from the group consisting of anionic, nonionic, cationic surfactants and mixtures thereof. Preferably the compositions are substantially free of betaine surfactants. Detergent surfactants useful herein are described in U.S. Pat. No. 3,664,961, Norris, issued May 23, 1972, U.S. Pat. No. 3,919,678, Laughlin et al., issued Dec. 30, 1975, U.S. Pat. No. 4,222,905, Cockrell, issued Sep. 16, 1980, and in U.S. Pat. No. 4,239,659, Murphy, issued Dec. 16, 1980. Anionic and nonionic surfactants are preferred.

Preferred nonionic surfactants are those of the formula $R^1(OC_2H_4)_nOH$, wherein $R^1$ is a $C_{10}$-$C_{16}$ alkyl group or a $C_8$-$C_{12}$ alkyl phenyl group, and n is from 3 to about 80. Particularly preferred are condensation products of $C_{12}$-$C_{15}$ alcohols with from about 5 to about 20 moles of ethylene oxide per mole of alcohol, e.g., $C_{12}$-$C_{13}$ alcohol condensed with about 6.5 moles of ethylene oxide per mole of alcohol.

Fabric Care Benefit Agents

The compositions may comprise a fabric care benefit agent. As used herein, "fabric care benefit agent" refers to any material that can provide fabric care benefits such as fabric softening, color protection, pill/fuzz reduction, anti-abrasion, anti-wrinkle, and the like to garments and fabrics, particularly on cotton and cotton-rich garments and fabrics, when an adequate amount of the material is present on the garment/fabric. Non-limiting examples of fabric care benefit agents include cationic surfactants, silicones, polyolefin waxes, latexes, oily sugar derivatives, cationic polysaccharides, polyurethanes, fatty acids and mixtures thereof. Fabric care benefit agents when present in the composition, are suitably at levels of up to about 30% by weight of the composition, more typically from about 1% to about 20%, preferably from about 2% to about 10%.

Detersive Enzymes

Detersive enzymes may be incorporated into the compositions of the present invention. Suitable detersive enzymes for use herein include protease, amylase, lipase, cellulase, carbohydrase including mannanase and endoglucanase, and mixtures thereof. Enzymes can be used at their art-taught levels, for example at levels recommended by suppliers such as Novo and Genencor. Typical levels in the compositions are from about 0.0001% to about 5%. When enzymes are present, they can be used at very low levels, e.g., from about 0.001% or lower, in certain embodiments of the invention; or they can be used in heavier-duty laundry detergent formulations in accordance with the invention at higher levels, e.g., about 0.1% and higher. In accordance with a preference of some consumers for "non-biological" detergents, the present invention includes both enzyme-containing and enzyme-free embodiments.

Deposition Aid

Deposition aids may be incorporated into the composition of the present invention. As used herein, "deposition aid" refers to any cationic polymer or combination of cationic polymers that significantly enhance the deposition of a fabric care benefit agent onto the fabric during laundering.

Preferably, the deposition aid is a cationic or amphoteric polymer. The amphoteric polymers of the present invention will also have a net cationic charge, i.e.; the total cationic charges on these polymers will exceed the total anionic charge. Nonlimiting examples of deposition enhancing agents are cationic polysaccharides, chitosan and its derivatives and cationic synthetic polymers.

Preferred cationic polysaccharides include cationic cellulose derivatives, cationic guar gum derivatives, chitosan and derivatives and cationic starches.

Rheology Modifier

In a preferred embodiment of the present invention, the composition comprises a rheology modifier. The rheology modifier is selected from the group consisting of non-polymeric crystalline, hydroxy-functional materials, polymeric rheology modifiers which impart shear thinning characteristics to the aqueous liquid matrix of the composition. Crystalline, hydroxy-functional materials are rheology modifiers which form thread-like structuring systems throughout the matrix of the composition upon in situ crystallization in the matrix. Specific examples of preferred crystalline, hydroxyl-containing rheology modifiers include castor oil and its derivatives. Especially preferred are hydrogenated castor oil derivatives such as hydrogenated castor oil and hydrogenated castor wax. Commercially available, castor oil-based, crystalline, hydroxyl-containing rheology modifiers include THIXCIN® from Rheox, Inc. (now Elementis). Polymeric rheology modifiers are preferably selected from polyacrylates, polymeric gums, other non-gum polysaccharides, and combinations of these polymeric materials. Preferred polymeric gum materials include pectine, alginate, arabinogalactan (gum Arabic), carrageenan, gellan gum, xanthan gum, guar gum and mixtures thereof.

Builder

The compositions of the present invention may optionally comprise a builder. Suitable builders include polycarboxylate builders include cyclic compounds, particularly alicyclic compounds, such as those described in U.S. Pat. Nos. 3,923,679; 3,835,163; 4,158,635; 4,120,874 and 4,102,903. Particularly preferred are citrate builders, e.g., citric acid and soluble salts thereof (particularly sodium salt Other preferred builders include ethylene diamine disuccinic acid and salts thereof (ethylene diamine disuccinates, EDDS), ethylene diamine tetraacetic acid and salts thereof (ethylene diamine tetraacetates, EDTA), and diethylene triamine penta acetic acid and salts thereof (diethylene triamine penta acetates, DTPA), aluminosilicates such as zeolite A, B or MAP; fatty acids or salts, preferably sodium salts, thereof, preferably C12-C18 saturated and/or unsaturated fatty acids; and alkali or alkali earth metal carbonates preferably sodium carbonate.

Bleaching System

Bleaching agents suitable herein include chlorine and oxygen bleaches, especially inorganic perhydrate salts such as sodium perborate mono- and tetrahydrates and sodium percarbonate optionally coated to provide controlled rate of release (see, for example, GB-A-1466799 on sulfate/carbonate coatings), preformed organic peroxyacids and mixtures thereof with organic peroxyacid bleach precursors and/or transition metal-containing bleach catalysts (especially manganese or cobalt). Inorganic perhydrate salts are typically incorporated at levels in the range from about 1% to about 40% by weight, preferably from about 2% to about 30% by weight and more preferably from abut 5% to about 25% by weight of composition. Peroxyacid bleach precursors preferred for use herein include precursors of perbenzoic acid and substituted perbenzoic acid; cationic peroxyacid precursors; peracetic acid precursors such as TAED, sodium acetoxybenzene sulfonate and pentaacetylglucose; pernonanoic acid precursors such as sodium 3,5,5-trimethylhexanoyloxybenzene sulfonate (iso-NOBS) and sodium nonanoyloxybenzene sulfonate (NOBS); amide substituted alkyl peroxyacid precursors (EP-A-0170386); and benzoxazin peroxyacid precursors (EP-A-0332294 and EP-A-0482807). Bleach precursors are typically incorporated at levels in the range from about 0.5% to about 25%, preferably from about 1% to about 10% by weight of composition while the preformed organic peroxyacids themselves are typically incorporated at levels in the range from 0.5% to 25% by weight, more preferably from 1% to 10% by weight of composition. Bleach catalysts preferred for use herein include the manganese triazacyclononane and related complexes (U.S. Pat. No. 4,246,612, U.S. Pat. No. 5,227,084); Co, Cu, Mn and Fe bispyridylamine and related complexes (U.S. Pat. No. 5,114,611); and pentamine acetate cobalt(III) and related complexes (U.S. Pat. No. 4,810,410).

Other Adjuncts

Examples of other suitable cleaning adjunct materials include, but are not limited to; enzyme stabilizing systems; antioxidants, opacifier, pearlescent agent, hueing dye, scavenging agents including fixing agents for anionic dyes, complexing agents for anionic surfactants, and mixtures thereof; optical brighteners or fluorescers; soil release polymers; dispersants; suds suppressors; dyes; colorants; hydrotropes such as toluenesulfonates, cumenesulfonates and naphthalenesulfonates; color speckles; perfumes and perfume microcapsules, colored beads, spheres or extrudates; clay softening agents and mixtures thereof.

Composition Preparation

The compositions herein can generally be prepared by mixing the ingredients together. If a pearlescent material is used it should be added in the late stages of mixing. If a rheology modifier is used, it is preferred to first form a pre-mix within which the rheology modifier is dispersed in a portion of the water and optionally other ingredients eventually used to comprise the compositions. This pre-mix is formed in such a way that it forms a structured liquid. To this structured pre-mix can then be added, while the pre-mix is under agitation, the surfactant(s) and essential laundry adjunct materials, along with water and whatever optional detergent composition adjuncts are to be used.

Secondary Packaging

The multi-compartment pouches of the present invention are preferably further packaged in an outer package. Said outer package may be a see-through or partially see-through container, for example a transparent or translucent bag, tub, carton or bottle. The pack can be made of plastic or any other suitable material, provided the material is strong enough to protect the pouches during transport. This kind of pack is also very useful because the user does not need to open the pack to see how many pouches there are left. Alternatively, the pack can have non-see-through outer packaging, perhaps with indicia or artwork representing the visually-distinctive contents of the pack.

Process of Washing

The pouches of the present invention are suitable for laundry cleaning applications. The pouches are suitable for hand or machine washing conditions. When machine washing, the pouch may be delivered from the dispensing drawer or may be added directly into the washing machine drum.

Examples

The following solvent system formulations 1 to 6 are prepared comprising differing combinations and levels of solvent. Formulations 1 and 2 are comparative and do not show the preferred reduced % change in stress. All solvent system formulations below comprise 9.5% water.

| | 1,2 Pdiol | Glycerol | PEG 400 | PEG 200 | stress (γ) change |
|---|---|---|---|---|---|
| Formulation 1 | 14% | 5% | 0.0% | 0.0% | 36.5% |
| Formulation 2 | 5.4% | 5.4% | 0.0% | 5.4% | 33.5% |
| Formulation 3 | 5.4% | 5.4% | 5.4% | 0.0% | 29.5% |
| Formulation 4 | 7.8% | 2.0% | 6.5% | 0.0% | 20.4% |
| Formulation 5 | 4.2% | 3.6% | 8.5% | 0.0% | 20.6% |
| Formulation 6 | 2.5% | 2.9% | 10.9% | 0.0% | 13.2% |

The % change in stress (γ) was measured, at 100% strain, as compared to virgin, untreated M8900 film available from MonoSol (Merrilville, Ind. (USA)).

The following solvent system formulations 7 to 13 are prepared comprising differing combinations and levels of solvent. The % change in stress (γ) is measured, at 100% strain, as compared to virgin, untreated M8900 film available from MonoSol. Formulation 13 is comparative and does not show the reduced % change in stress.

| | 1,2 Pdiol | Glycerol | PEG 400 | DPG | stress (γ) change |
|---|---|---|---|---|---|
| Formulation 7 | 4.2% | 2.5% | 0.00% | 9.5% | 16.4% |
| Formulation 8 | 4.2% | 1.5% | 0.00% | 10.5% | 7.9% |
| Formulation 9 | 4.2% | 3.6% | 8.5% | | 20.6% |
| Formulation 10 | 2.5% | 2.9% | 10.9% | | 13.2% |

| | 1,2 Pdiol | Glycerol | nBPP | stress (γ) change |
|---|---|---|---|---|
| Formulation 11 | 3% | 4% | 9% | 32.9% |
| Formulation 12 | 3% | 1.5% | 10.5% | 32% |
| Formulation 13 | 10.5 | 1.5% | 0% | 49% |

Pouch Strength

Pouch Strenth is measured with an Instrom 4465 (Instron, 100 Royall Street, Canton Mass.). The pouch is inserted into a plastic bag (150 mm×180 mm) and the air is removed from the bag. The pouch is then placed on its side between the two compression plates. By 'on its side' it is meant that pouch is placed such that the face of the pouch faces outwards and the pouch is held by the compression plates at lines of sealing. A steady increasing force is applied automatically by the Instrom until the pouch bursts. The force required to burst the pouch is then recorded; this is the pouch strength expressed in Newton (N). The broken pouch is then examined and the type of breakage is recorded (i.e. whether the film or the seal broke). Each number is an average of 10 repetitions.

The strength of pouches comprising formulation 5, above and representative of the invention, is compared against the strength of pouches comprising formulation 1, above. The film used to make each pouch is identical. As can be seen from the results below, the pouch comprising formulation 5 produces a stable pouch strength over time. The strength of the pouch comprising formulation 1, however, weakens rapidly over the first 10 days and then further still over a total period of 30 days.

| Pouch Strength (N) | Formulation 1 | Formulation 5 |
|---|---|---|
| Fresh | 550 ± 97 | 550 ± 97 |
| 10 days 35C | 262 ± 58 | 418 ± 98 |
| 20 days 35C | 267 ± 51 | 507 ± 74 |
| 30 days 35C | 211 ± 57 | 528 ± 90 |

Detergent Compositions according to the present invention are prepared as set out below, compositions A to E. All levels are in weight percent of the composition.

| Ingredients | A | B | C | D | E |
|---|---|---|---|---|---|
| Linear $C_9$-$C_{15}$ Alkylbenzene sulfonic acid | 18.5 | 20 | 18.5 | 20 | 20 |
| $C_{12-14}$ alkyl 7-ethoxylate | 14.2 | 18 | 14.2 | 18 | 14 |
| Citric Acid | 0.5 | | 0.5 | | 0.5 |
| Top palm kernel fatty acid | 9.0 | 20 | 9.0 | 20 | 15 |
| C12-14 alkyl ethoxy 3 sulfate | 9 | | 9 | | |
| Chelant | 1.5 | | 1.5 | | 0.6 |
| Polymer | 4 | 0 | 4 | 0 | 2.0 |
| Enzymes | 1.6 | 0 | 1.6 | 1.2 | 1.2 |
| Perfume | 1.7 | | 1.7 | | 2.0 |
| Propanediol | 4.0 | | 0.0 | | 14.0 |
| Glycerol | 1.5 | | 0.0 | | |
| Water | 9.5 | 6.0 | 9.5 | 6.0 | 7.0 |
| PEG 400 | — | 19.0 | — | 19.0 | |
| DPG | 10.5 | — | 14.0 | — | |
| nBPP | — | — | — | — | 5.0 |
| Monoethanol amine or NaOH (or mixture thereof) | neutralize to pH to about 7.6 | neutralize to pH to about 7.5 | neutralize to pH to about 7.6 | neutralize to pH to about 7.4 | neutralize to pH to about 7.4 |
| Additives, Minor | To 100% | To 100% | To 100% | To 100% | To 100% |

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method for controlling the plasticization of a water soluble film comprising i) preparing a liquid detergent composition comprising a) anionic surfactant, wherein the an anionic surfactant selected from the group consisting of sodium, potassium, and ammonium alkyl polyethoxylate sulfates in which the alkyl group contains from 10 to 22 carbon atoms and wherein the polyethoxylate chain contains from 1 to 15 ethoxylate moieties; sodium and potassium linear alkylbenzene sulfonates in which the alkyl group contains from about 9 to about 15 carbon atoms; and mixtures thereof is present at a level of from about 10% to about 40% by weight of the composition, and b) solvent system comprising at least one primary solvent having Hansen Solubility (δ) of less than about 30, and wherein said solvent system further comprises a secondary solvent, wherein the primary solvent has a cLog P of greater than about −1.0, and wherein the primary solvent has a Hydrogen Bonding Component of less than about 20.5, wherein the primary solvent is selected from the group consisting of polyethylene glycol (PEG) polymer having molecular weight between about 400 and about 600, dipropylene glycol (DPG), nbutoxy propoxy propanol (nBPP) and mixtures thereof, wherein the secondary solvent is glycerol, wherein the primary solvent is present at a level of from about 1 to about 25%, and wherein the weight ratio of primary solvent to secondary solvent is from about 7:1 to about 1:5;

ii) encapsulating said liquid detergent composition in a water soluble film to form a pouch unitized dose product, wherein said pouch unitized dose product is a multi-compartment pouch, wherein each compartment contains a different liquid composition.

2. The method according to claim 1, wherein the water soluble film comprises a copolymer of vinyl alcohol and a monomer comprising a sulphonate group.

3. The method according to claim 1, wherein the primary solvent is polyethylene glycol (PEG) polymer having molecular weight between about 400 and about 600.

4. The method according to claim 1, wherein the primary solvent is present at a level of from about 2.5 to about 20%.

5. A method for controlling the plasticization of a water soluble film comprising i) preparing a liquid detergent composition comprising a) an anionic surfactant selected from the group consisting of sodium, potassium, and ammonium alkyl polyethoxylate sulfates in which the alkyl group contains from 10 to 22 carbon atoms and wherein the polyethoxylate chain contains from 1 to 15 ethoxylate moieties; sodium and potassium linear alkylbenzene sulfonates in which the alkyl group contains from about 9 to about 15 carbon atoms; and mixtures thereof, wherein the anionic surfactant is present at a level of from about 10% to about 40% by weight of the composition, and b) solvent system comprising at least one primary solvent having Hansen Solubility (δ) of less than about 30, wherein the primary solvent is selected from the group consisting of polyethylene glycol (PEG) polymer having molecular weight between about 400 and about 600, dipropylene glycol (DPG), nbutoxy propoxy propanol (nBPP) and mixtures thereof, wherein the primary solvent is present at a level of from about 1 to about 25%;

ii) encapsulating said liquid detergent composition in a water soluble film to form a pouch unitized dose product, wherein said pouch unitized dose product is a multi-compartment pouch, wherein each compartment contains a different liquid composition, wherein the solvent system additionally comprises a secondary solvent which is glycerol, wherein glycerol is present at a level of less than about 5%, and wherein the weight ratio of primary solvent to glycerol is from about 7:1 to about 1:5.

6. The method according to claim 5, wherein the secondary solvent glycerol is present at a level of less than about 4%.

7. The method according to claim 5, wherein the solvent system further comprises water, wherein the water is present at a level of less than about 20%.

8. The method according to claim 5, wherein the weight ratio of primary solvent to glycerol is from about 6.5:1 to about 1:3.

9. The method according to claim 5, wherein the weight ratio of primary solvent to glycerol is from about 3:1 to about 1:1.

10. The method according to claim 5, wherein glycerol is present at a level of less than about 3% by weight of the composition.

11. The method according to claim 7, wherein the water is present at a level of less than about 15%.

12. The method according to claim 5, wherein the film comprises bulky monomeric units, wherein the bulky monomeric units comprise monomers selected from the group consisting of sulphonate; 2-acrylamido-2-methylpropane sulfonic acid; 2 methacrylamido-2-methyl propane sulfonic acid; and mixtures thereof.

13. The method according to claim 5, wherein the water soluble film comprises a copolymer of vinyl alcohol and a monomer comprising a sulphonate group.

14. The method according to claim 1, wherein the multi-compartment pouch includes a first compartment, and a second compartment superposed on the first compartment.

15. The method according to claim 14, wherein the multi-compartment pouch further comprises a third compartment superposed on the first compartment.

16. The method according to claim 1, wherein the primary solvent is dipropylene glycol (DPG).

17. The method according to claim 1, wherein the primary solvent is nbutoxy propoxy propanol (nBPP).

* * * * *